US006536055B2

(12) United States Patent
Pondelick et al.

(10) Patent No.: US 6,536,055 B2
(45) **Date of Patent: *Mar. 25, 2003**

(54) MODULAR VACUUM TOILET WITH LINE REPLACEABLE UNITS

(75) Inventors: Mark A. Pondelick, Roscoe, IL (US); Jay D. Stradinger, Roscoe, IL (US); William Bruce Anderson, Rockford, IL (US); Arthur J. McGowan, Jr., Thornton, CO (US); Douglas M. Wallace, Roscoe, IL (US); Ian Tinkler, Rockford, IL (US); Michael B. Hancock, Rockford, IL (US)

(73) Assignee: Evac International Oy, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/061,681

(22) Filed: Feb. 1, 2002

(65) Prior Publication Data

US 2002/0069459 A1 Jun. 13, 2002

Related U.S. Application Data

(63) Continuation of application No. 09/713,892, filed on Nov. 16, 2000, now Pat. No. 6,353,942.

(51) Int. Cl.[7] ..... E03D 11/00

(52) U.S. Cl. ..... 4/431; 4/434; 4/435; 137/588; 137/595

(58) Field of Search ..... 4/300, 316, 420, 4/431–435, 458; 137/588, 595

(56) References Cited

U.S. PATENT DOCUMENTS

| | | | | |
|---|---|---|---|---|
| 3,239,849 A | | 3/1966 | Lilgendahl | |
| 3,860,973 A | * | 1/1975 | Uyeda et al. | 4/435 |
| 3,922,730 A | | 12/1975 | Kemper | |
| 3,995,328 A | | 12/1976 | Carolan et al. | |
| 4,063,315 A | | 12/1977 | Carolan et al. | |
| 4,184,506 A | | 1/1980 | Varis et al. | |
| 4,246,925 A | | 1/1981 | Oldfelt | |
| 4,275,470 A | | 6/1981 | Badger et al. | |
| 4,357,719 A | | 11/1982 | Badger et al. | |
| 4,521,925 A | | 6/1985 | Chen et al. | |
| 4,713,847 A | | 12/1987 | Oldfelt et al. | |
| 5,007,117 A | | 4/1991 | Oldfelt et al. | |
| 5,133,853 A | | 7/1992 | Mattsson et al. | |
| 5,271,105 A | * | 12/1993 | Tyler | 4/431 |
| 5,604,938 A | | 2/1997 | Tyler | |
| 5,732,417 A | | 3/1998 | Pondelick | |
| 5,909,968 A | * | 6/1999 | Olin et al. | 4/431 |
| 6,131,596 A | | 10/2000 | Monson | |
| 6,152,160 A | | 11/2000 | Bowden Wilcox et al. | |
| 6,216,285 B1 | | 4/2001 | Olin | |

* cited by examiner

*Primary Examiner*—David J. Walczak
*Assistant Examiner*—Tuan Nguyen
(74) *Attorney, Agent, or Firm*—Marshall, Gerstein & Borun

(57) ABSTRACT

A modular vacuum toilet, and a method of servicing such a toilet, are disclosed. The toilet is used with a vacuum toilet system having a sewer line placeable under partial vacuum pressure and a source of rinse fluid. The modular vacuum toilet comprises a frame and a removable bowl engaging and supported be the frame, the bowl defining an outlet and having a rinse fluid dispenser associated therewith. The modular vacuum toilet also has a valve set module. The valve set module includes a discharge valve having an inlet in fluid communication with the bowl outlet, an outlet in fluid communication with the sewer line, and a movable discharge valve member disposed between the discharge valve inlet and outlet. A rinse fluid valve is also incorporated into the valve set module and has an inlet in fluid communication with the source of rinse fluid, an outlet in fluid communication with the rinse fluid dispenser, and a movable rinse fluid valve member disposed between the rinse fluid valve inlet and outlet. The valve set module further includes a flush control unit having a circuit board operably connected to the discharge valve and rinse fluid valve for controlling actuation of the discharge valve member and rinse fluid valve member.

28 Claims, 9 Drawing Sheets

10
33
39
29
40
39
28
29
46
46
46
30
74
36
38
42
47
32
26
20
26
44
76
37
8
45
37
27
26
24
72

MODULAR VACUUM TOILET WITH LINE REPLACEABLE UNITS

This is a continuation of U.S. Application Ser. No. 09/713,892 filed Nov. 16, 2000 now U.S. Pat. No. 6,353,942.

FIELD OF THE INVENTION

The present invention generally relates to toilets and, more particularly, to vacuum toilet systems.

BACKGROUND OF THE INVENTION

Vacuum toilet systems are generally known in the art for use in both vehicle and stationary applications. A vacuum toilet system typically comprises a bowl for receiving waste having an outlet connected to a vacuum sewer line. A discharge valve is disposed between the bowl outlet and vacuum sewer line to selectively establish fluid communication therebetween. The vacuum sewer line is connected to a collection tank that is placed under partial vacuum pressure by a vacuum source, such as a vacuum blower. When the discharge valve is opened, material in the bowl is transported to the sewer pipe as a result of the pressure difference between the interior of the bowl and the interior of the sewer line. Conventional vacuum toilet systems also include a source of rinse fluid and a rinse fluid valve for controlling introduction of rinse fluid into the bowl.

The components of a conventional vacuum toilet are typically provided separately and are overly difficult to assemble. The discharge valve is typically mounted in a first position, while the rinse valve is mounted in a second, separate position. A flush control unit (FCU) is mounted remote from both valves and provides control signals to the discharge and rinse valve actuators. Accordingly, various mounting brackets, tubing, and wires are needed to interconnect the various components, making assembly overly complicated and time-consuming.

In addition, the separate components used in conventional vacuum toilets make repair and maintenance overly time consuming and labor intensive. Maintenance concerns are particularly significant in aircraft applications, in which a number of sub-systems are installed on board. According to general practice in the airline industry, each sub-system includes one or more components which must be replaced in the event of failure, such replacement components being commonly referred to as line replaceable units (LRUs). Presently, the entire vacuum toilet is defined as the LRU for the vacuum toilet system. As a result, an airline must stock one or more replacement toilets in the event of a toilet failure, so that the replacement toilet may be swapped in for the faulty toilet. A "bench test" is then performed on the faulty toilet to determine which components have failed in the toilet. The faulty components are then repaired or replaced (which may include significant disassembly and reassembly of the toilet) so that the toilet may be reused on another aircraft.

Each of the steps performed during a toilet repair is overly difficult and time consuming. To remove an entire toilet assembly from an aircraft requires disassembly of at least four self-locking mounting fasteners, an electrical connection, a grounding strap, a potable water line connection, and a waste discharge pipe connection. Each connection may be difficult to access, and may require a particular tool in order to loosen and disconnect. The same connections must then be reconnected for the replacement toilet.

Even if it were possible to remove and replace a single toilet component, it would be overly difficult and time consuming to do so. Removal of a component would require disconnection of several wires and pipes, and the components are often located in areas which are difficult to access. Furthermore, it would be difficult to diagnose whether one component or several components had failed. There exists a multitude of combinations of simultaneous component failures, which may lead to trouble-shooting errors and the replacement or repair of non-faulty components.

In view of the foregoing, it is apparent that the replacement and repair of conventional toilets is overly time consuming, and requires an airline to maintain a large stock of replacement toilets in the event of equipment failure.

Other repairs, which may not require substantial amounts of trouble shooting to identify the failed components, still require significant amounts of disassembly and reassembly. The toilet bowl, for example, is typically formed of stainless steel covered with a non-stick coating that is subject to failure. In conventional toilets, the bowl is a structural, load bearing component that is attached to a base support. In some toilets, the base support is permanently attached to the bowl and therefore the entire toilet must be removed to replace the coating. In other toilets, the bowl is removable from the support base, and therefore fasteners must be removed and the bowl must be disconnected from the rinse fluid and discharge lines. In addition, the rinse ring or nozzle used to direct rinse fluid into the bowl must be removed. Furthermore, if the non-stick coating fails, the bowl must be removed from all of the other toilet components for a re-coating process, steps of which are performed at high temperature to remove the old coating and apply a new coating to the toilet bowl surface. Accordingly, the replacement of a conventional bowl is overly complicated and time consuming.

From the foregoing, it will be appreciated that a number of toilets must be kept in stock for replacement in the event of a faulty toilet. The number of stock toilets is further increased due to the left-handed and right-handed discharge configurations of conventional vacuum toilets. Typically, the component layout of a conventional vacuum toilet must be modified according to the type of discharge configuration desired. In addition, different components maybe required, such as a toilet bowl with a left-handed or right-handed discharge. As a result, an airline must have both left- and right-handed discharge replacement toilets on hand, thereby increasing the number of stock parts required.

From the above, it will be appreciated that a need exists for a vacuum toilet that is easier to maintain and which reduces the number of stock parts required.

SUMMARY OF THE INVENTION

In accordance with certain aspects of the present invention, a modular vacuum toilet is provided for use in a vacuum toilet system having a sewer line placeable under partial vacuum pressure and a source of rinse fluid. The modular vacuum toilet comprises a support structure, and a removable bowl supported by the support structure, the bowl defining an outlet and having a rinse fluid dispenser associated therewith. A valve set module is provided having a discharge valve with an inlet in fluid communication with the bowl outlet, an outlet in fluid communication with the sewer line, and a movable discharge valve member disposed between the discharge valve inlet and outlet; a rinse fluid valve having an inlet in fluid communication with the source of rinse fluid, an outlet in fluid communication with the rinse fluid dispenser, and a movable rinse fluid valve member disposed between the rinse fluid valve inlet and outlet; and a flush control unit having a circuit board operably connected to the discharge. valve and rinse fluid valve for controlling actuation of the discharge valve member and rinse fluid valve member.

In accordance with additional aspects of the present invention, a method of servicing a vacuum toilet is provided, in which the vacuum toilet is attached to a vacuum toilet system having a sewer line placeable under partial vacuum pressure and a source of rinse fluid, and in which the vacuum toilet includes a waste receptacle defining an outlet and having a rinse fluid dispenser associated therewith. The method comprises providing a first valve set module having a discharge valve with an inlet adapted to engage the receptacle outlet and an outlet adapted for releasable connection to the sewer line, a rinse fluid valve with an inlet adapted for releasable connection to the source of rinse fluid and an outlet adapted for releasable connection to the rinse fluid dispenser, and a flush control unit adapted to control operation of the discharge valve and rinse fluid valve. The discharge valve is detached from the bowl outlet, discharge valve outlet from the sewer line, the rinse fluid valve inlet from the rinse fluid source, and the rinse fluid valve outlet from the rinse fluid line, and the valve set module is removed from the vacuum toilet. A second valve set module is inserted into the vacuum toilet, the second valve set module including a discharge valve with an inlet adapted to engage the receptacle outlet and an outlet adapted for releasable connection to the sewer line, a rinse fluid valve with an inlet adapted for releasable connection to the source of rinse fluid and an outlet adapted for releasable connection to the rinse fluid dispenser, and a flush control unit adapted to control operation of the discharge valve and rinse fluid valve. The second valve set discharge valve inlet is then attached to the bowl outlet, the discharge valve outlet to the sewer line, the rinse fluid valve inlet to the rinse fluid source, and the rinse fluid valve outlet to the rinse fluid line.

In accordance with further aspects of the present invention, a method of servicing a vacuum toilet is provided wherein the toilet has a receptacle for receiving waste defining an outlet and includes a rinse fluid dispenser associated therewith. A discharge valve has an inlet in fluid communication with the receptacle outlet, an outlet in fluid communication with a sewer line placeable under partial vacuum pressure, and a moveable discharge valve member disposed between the discharge valve inlet and the discharge valve outlet. A rinse fluid valve has an inlet in fluid communication with a source of rinse fluid, an outlet in fluid communication with the rinse fluid dispenser, and a moveable rinse fluid valve member disposed between the rinse fluid valve inlet and the rinse fluid valve outlet. A flush control unit is adapted to control actuation of the discharge valve member and rinse fluid valve member, in which at least one of the discharge valve, rinse fluid valve, flush control unit, and waste receptacle is a line replaceable unit. The method comprises removing the faulty line replaceable unit from the toilet, and installing a new line replaceable unit into the toilet.

In accordance with still further aspects of the present invention, a valve set is provided for use in a vacuum toilet system having a sewer pipe placeable under partial vacuum pressure. The valve set comprises a discharge valve having an outlet, and an outlet pipe attached to the discharge valve outlet and defining a branch. A discharge pipe has a first end adapted to releasably engage the sewer pipe and a second end releasably attachable to the branch in at least a first position corresponding to a left-handed discharge configuration and a second position corresponding to a right-handed discharge configuration.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1A:
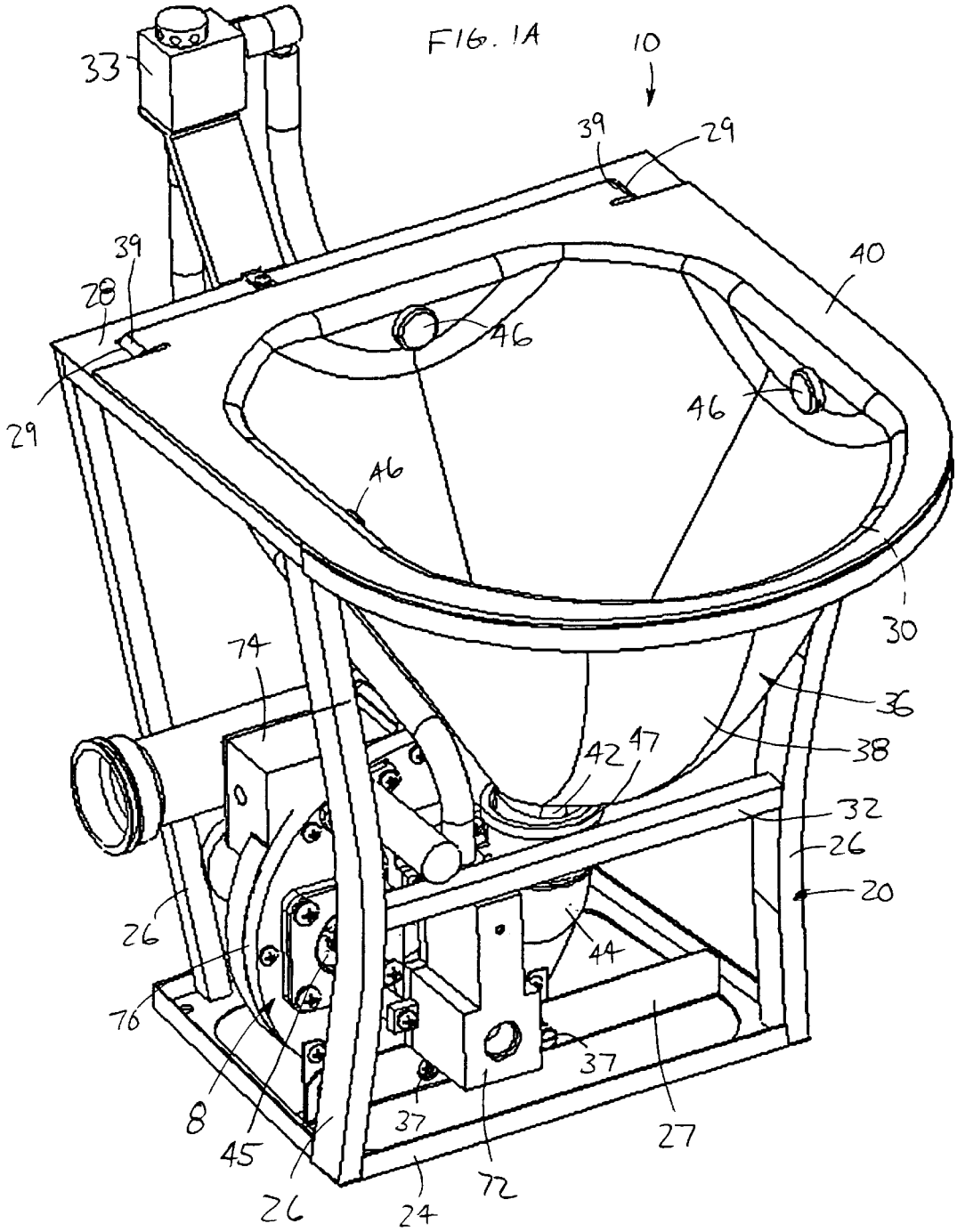
FIGS. 1A and 1B are front and rear perspective views, respectively, of a modular vacuum toilet in accordance with the present invention.
Figure 1B:
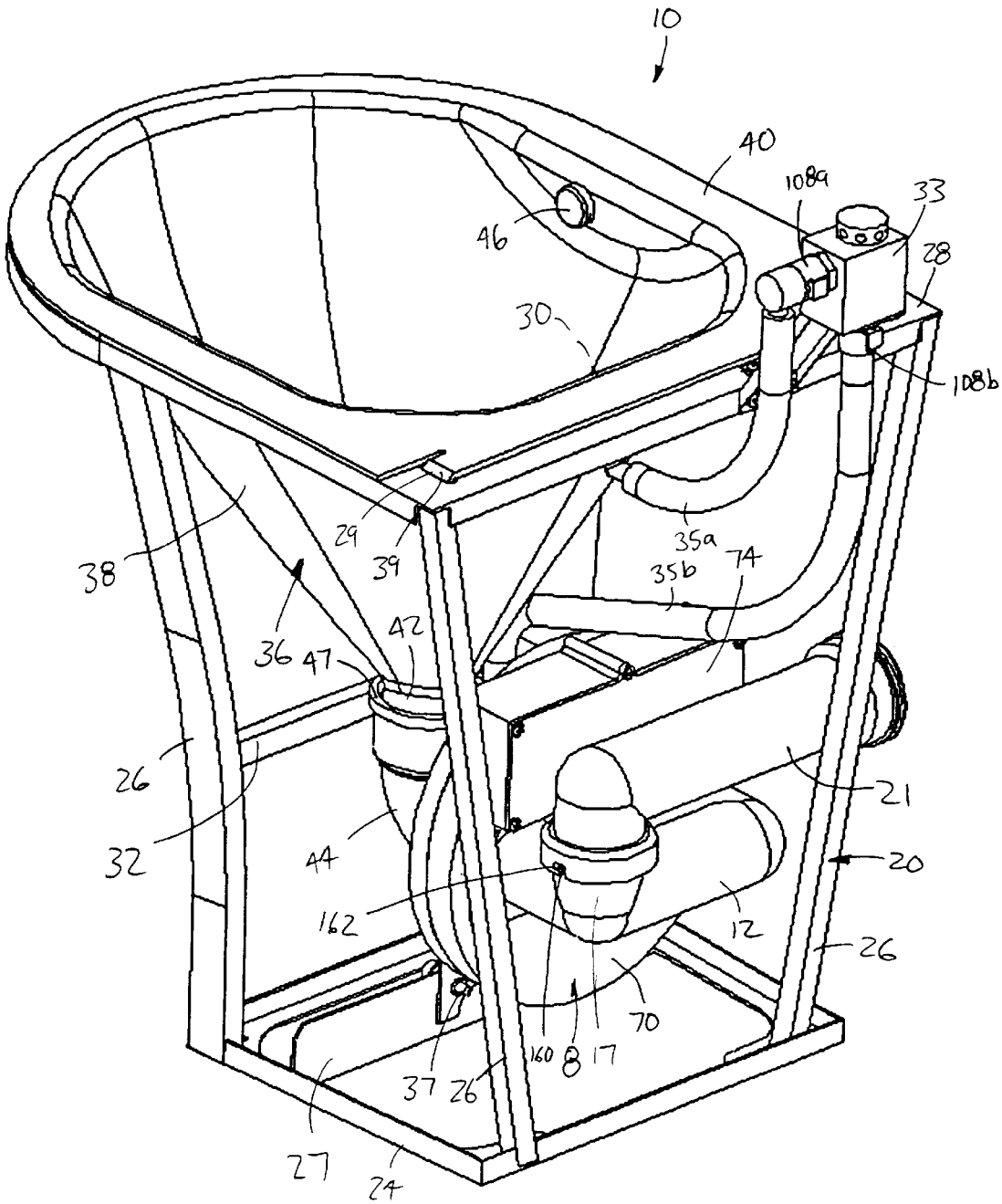
Figure 2:
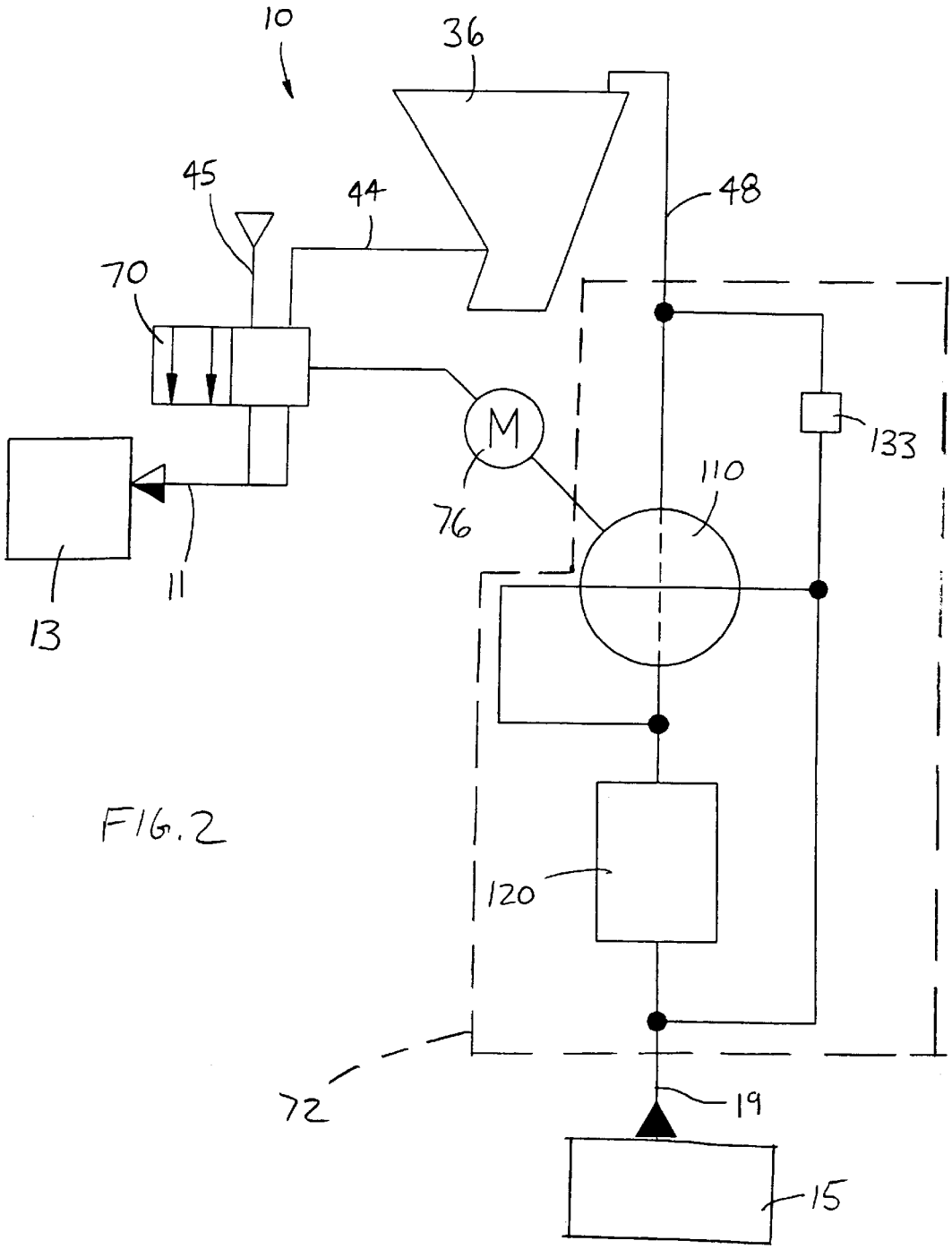
FIG. 2 is a schematic diagram of the vacuum toilet of FIG. 1.

Referring initially to FIGS. 1A, 1B, and 2, a modular vacuum toilet suitable for use in a vehicle, in accordance with the present invention, is generally referred to with reference numeral 10. The modular vacuum toilet 10 generally includes a valve set 8, a frame 20, and a bowl 36. The vehicle is provided with a sewer line 11, a vacuum tank 13 connected to the sewer line 11, and a vacuum source (not shown) for placing the vacuum tank 13 under partial vacuum pressure. The vehicle further includes a source of rinse fluid 15 connected to a rinse fluid supply line 19.

The frame 20 is provided for supporting the components of the vacuum toilet 10. As best shown with reference to FIGS. 1A and 1B, the frame 20 includes a bottom member 24 adapted for attachment to a support surface of the vehicle. Vertical supports 26 extend upwardly from the bottom member 24, and a top member 28 is attached to the vertical supports 26. The top member 28 is formed with an opening 30 near the front and two slots 29 near the rear thereof. In the illustrated embodiment, an intermediate support 32 is attached between adjacent vertical supports 26, and a bracket 27 is attached to the bottom member 24. The bottom member 24, top member 28, and bracket 27 are preferably formed of sheet metal, while the vertical supports 26 and intermediate support 32 are preferably formed of tube steel, both of which are readily available and inexpensive. Other materials having sufficient rigidity, however, may also be used.

Figure 3:
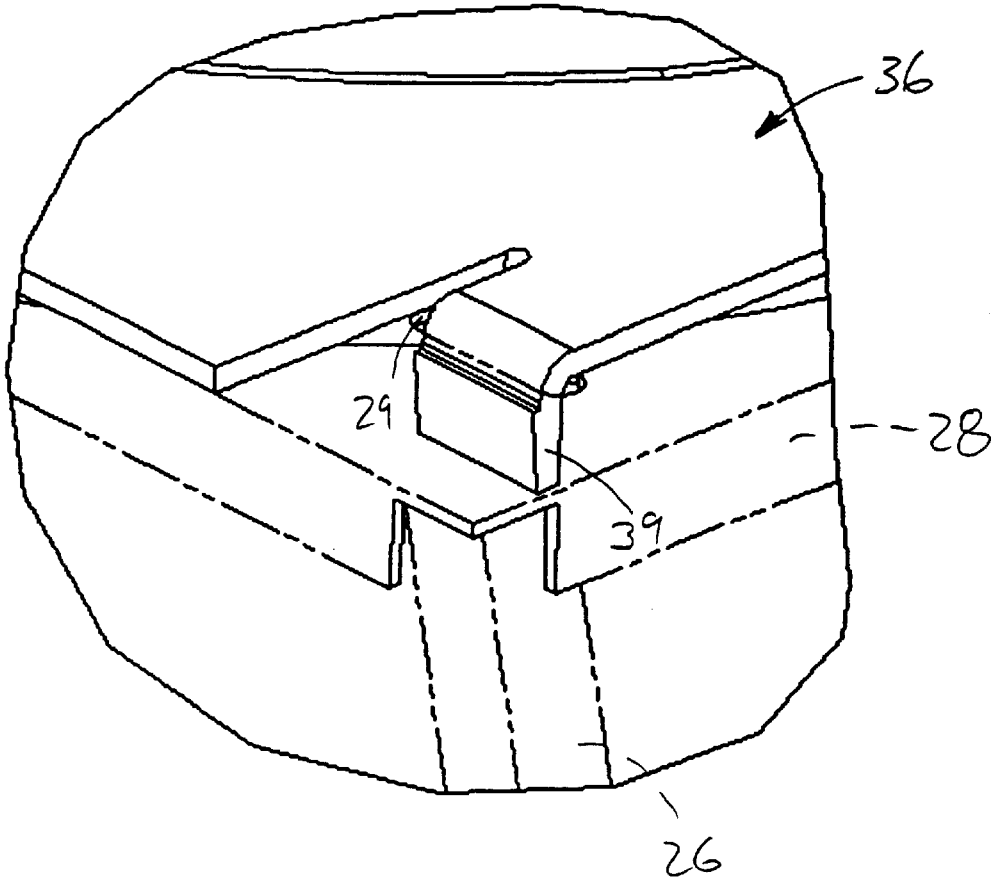
FIG. 3 is an enlarged view of a tab used to secure a bowl to the frame.

The bowl 36 is provided for receiving waste material. The bowl 36 has a curved sidewall 38 and an out-turned flange 40 extending about an upper edge of the sidewall (FIGS. 1A and 1B). The out-turned flange 40 further includes tabs 39 sized for insertion through the slots 29 formed in the frame top member 28, as best shown in FIG. 3. A bottom of the sidewall is formed in an outlet 42, and the sidewall 38 is sized for insertion into the opening 30 of the frame top member 28. The outlet 42 fluidly communicates with a discharge valve 70 through a transfer pipe 44. The transfer pipe 44 preferably includes a collar 47 sized to frictionally engage and seal with the outlet 42.

To attach the bowl 36 to the frame 20, the bowl 36 is inserted through the opening 30 and positioned so that the tabs 39 are aligned with the slots 29 and the outlet 42 is aligned with the collar 47. The bowl 36 is lowered so that the tabs 39 pass through and lock with the slots 29. Simultaneously, the outlet 42 is inserted into and engages the collar 47. In this position, the out-turned flange 40 closely overlies the frame top member 28 so that downward forces applied to the bowl 36 are transferred to the frame 20. As a result, the bowl 36 is not a load-bearing component, and may be made of non-structural materials such as plastic, thin-walled metal (defined herein as less than approximately 0.040" thick), or other known alternatives. In addition, the bowl 36 is separable from the frame 20 and therefore may be replaced independently from the rest of the toilet 10. Still further, the tabs 39 may be manipulated manually, and therefore no tools are required to install or remove the bowl 36.

At least one rinse fluid dispenser, such as nozzles 46, is provided inside the bowl 36 for directing rinse fluid over the surface of the bowl. As best shown in FIGS. 1A and 1B, a plurality of nozzles 46 are spaced about the bowl sidewall 38 and are oriented to direct rinse fluid over portions of the bowl surface. The number of nozzles may be more or less than that shown, depending on the size of the bowl surface to be rinsed. As used herein, the phrase "rinse fluid dispenser" includes the illustrated nozzles 46, as well as known substitutes, such as spray rings.

A vacuum breaker 33 is positioned above the top edge of the bowl 36, and a first rinse fluid pipe 35*a* extends from the nozzles 46 to the vacuum breaker 33. A second rinse fluid pipe 35*b* extends from the vacuum breaker 33 to a rinse valve 72. Quick-disconnect couplings 108*a,* 108*b* are provided to connect the first and second rinse fluid pipes 35*a,* 35*b* to the vacuum breaker 33.

The separate frame 20 advantageously allows the bowl 36 to be a line replaceable unit (LRU). When the bowl 36 becomes worn or otherwise needs replacement, a maintenance person may simply disconnect the first rinse fluid pipe 35*a* using the quick disconnect coupling 108*a,* manipulate the tabs 39 so that the are disengaged from the slots 29, and pull upward on the bowl 36 to remove the bowl 36 from the frame 20. A new bowl 36 may then be inserted into the frame 20 as described above, and the first rinse fluid pipe 35*a* maybe connected to the vacuum breaker 33 using the quick-disconnect coupling 108*a.* As a result, the entire toilet need not be removed and serviced. In addition to facilitating bowl removal and replacement, the frame 20 allows a wider range of materials to be used for the bowl 36, since the frame 20, rather than the bowl 36, supports the load.

Figure 4:
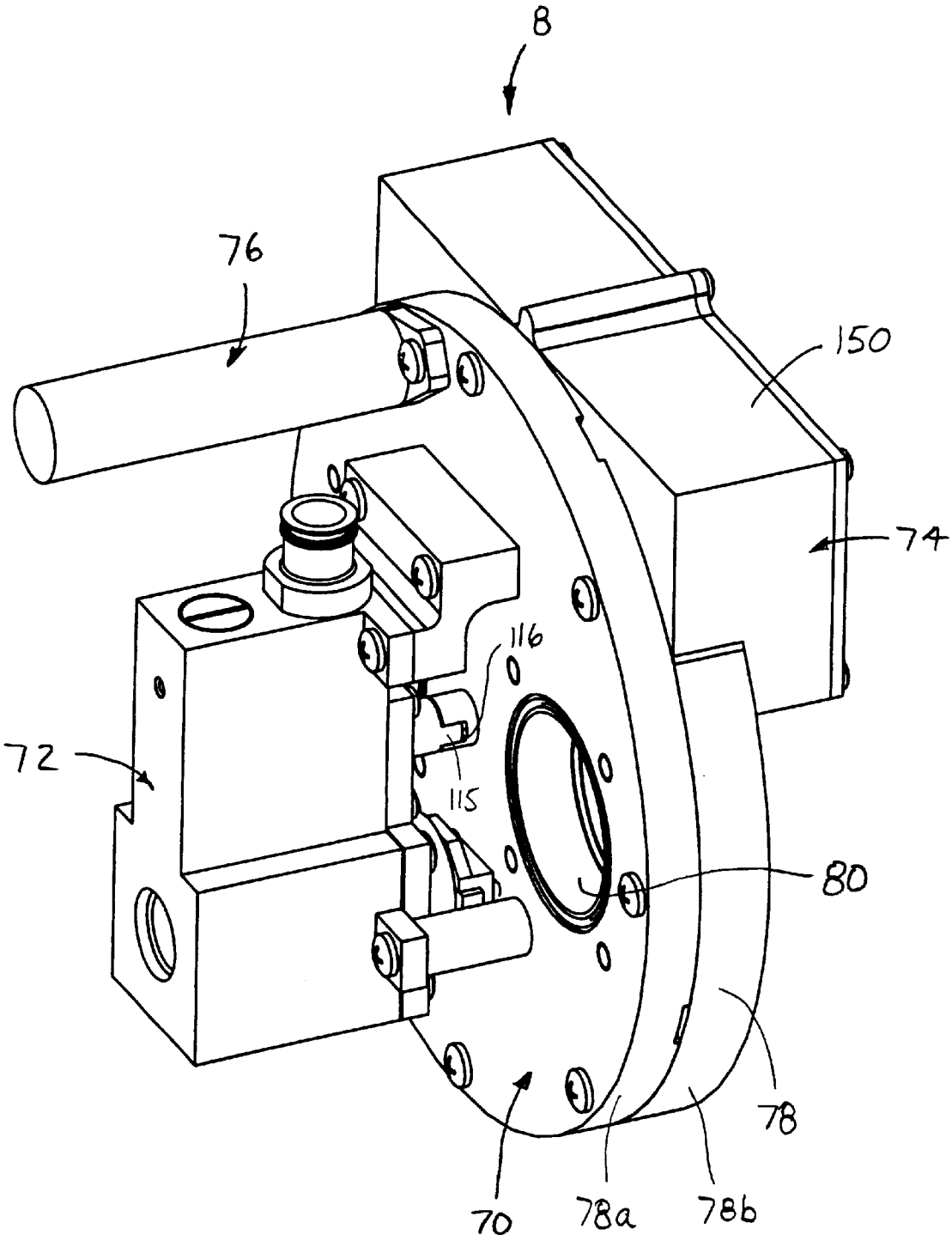
FIG. 4 is an enlarged perspective view of the valve set incorporated into the vacuum toilet of FIG. 1.
Figure 5B:
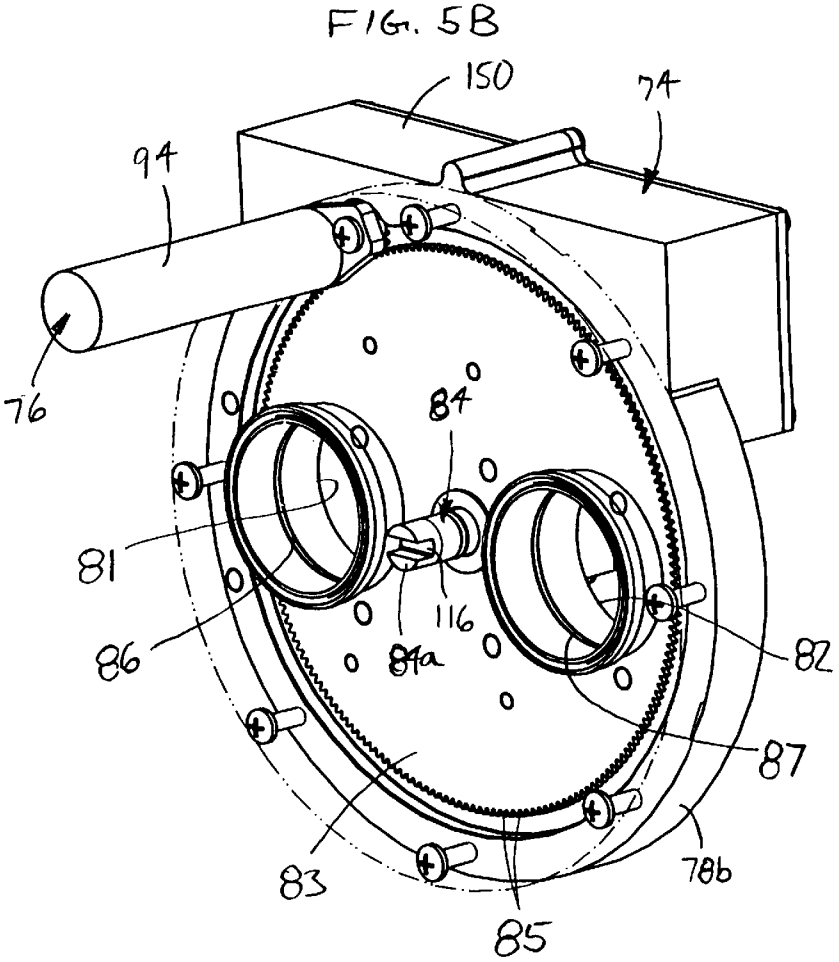
FIGS. 5A and 5B are perspective views of a discharge valve and actuator incorporated into the valve set.
Figure 5A:
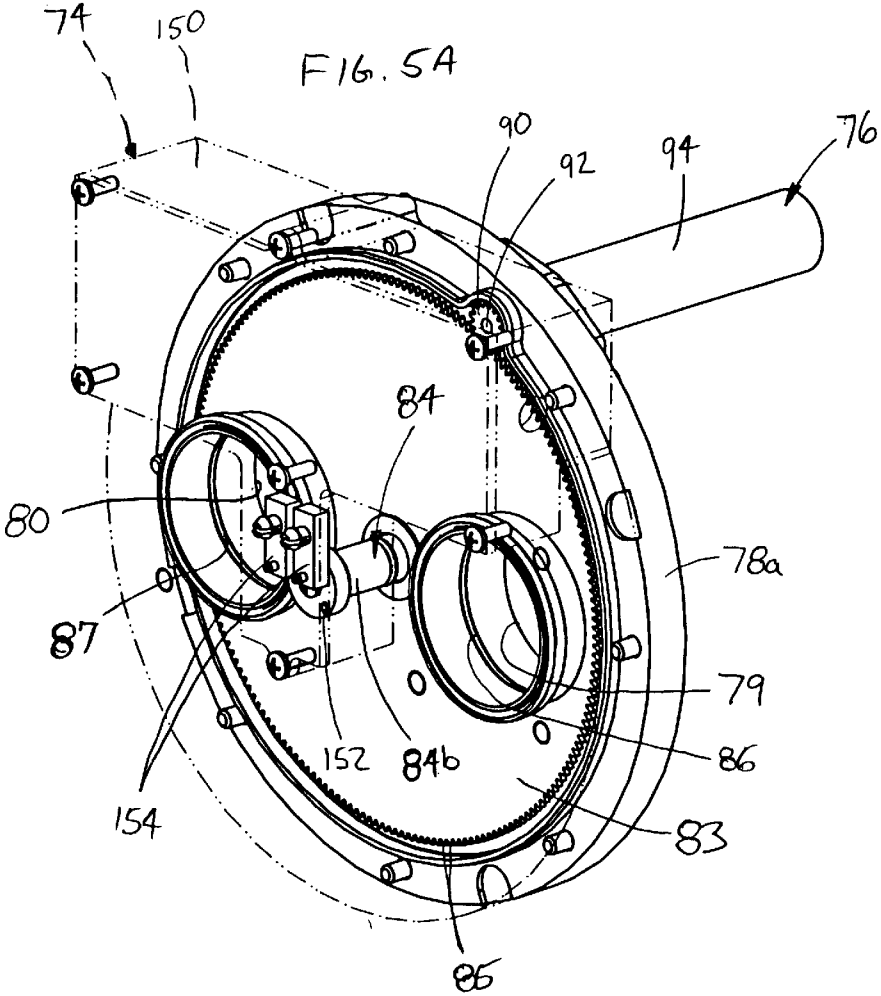

As best shown in FIG. 1A, the valve set 8 is mounted to the frame bracket 27. The valve set 8 is preferably attached to the bracket 27 using fasteners that may be manipulated by hand, such as knurled screws 37. The valve set 8 includes four sub-components: a discharge valve 70, a rinse valve 72, a flush control unit (FCU) 74, and an actuator 76 (FIG. 4). The discharge valve 70 includes a discharge valve housing 78 divided into two halves 78*a*, 78*b*. As best shown in FIGS. 5A and 5B, the housing 78 includes a pair of inlets 79, 80 formed in the housing half 78*a* aligned with a pair of outlets 81, 82 formed in the housing half 78*b*.

The housing 78 further defines a chamber for receiving a discharge valve member, such as valve disk 83. An axle 84 is attached to the valve disk 83 has two ends 84*a,* 84*b*. Holes are formed in the housing halves 78*a,* 78*b,* sized to receive the axle ends 84*a,* 84*b,* respectively, so that the disk 83 is supported for rotation about the axle 84. The periphery of the disk 83 is formed with gear teeth 85, and a pair of apertures 86, 87 are formed through the disk 83. The apertures 86, 87 are spaced so that both register simultaneously with the associated inlet/outlet pairs 79/81, 80/82 as the disk 83 rotates. In the illustrated embodiment, the apertures 86, 87 and associated inlet/outlet pairs 79/81, 80/82 are spaced 180 degrees apart.

According to the illustrated embodiment, the inlet 79 is connected to one end of the transfer pipe 44, with the other end of the transfer pipe 44 being attached to the bowl outlet 42. An air intake check valve 45 is attached to the other inlet 80, and is oriented to allow fluid to flow into the inlet 80 while preventing fluid from discharging out of the check valve 45 (FIGS. 1A and 2). A U-shaped outlet pipe 12 (FIG. 1B) has a first end connected to the outlet 81 and a second end connected to the outlet 82. The outlet pipe 12 further has a branch 17 leading to a discharge pipe 21.

In accordance with certain aspects of the present invention, the branch 17 and discharge pipe 21 are adapted to provide both right- and left-handed discharge configurations. As best shown in FIG. 1B, the branch 17 includes a pair of spaced pins 160 (only one shown in FIG. 1B) and the discharge pipe 21 a pair of spaced J-shaped slots 162 (only one shown in FIG. 1B) positioned to engage the pins, so that the discharge pipe 21 is removably attached to the branch 17. The pins 160 and J-shaped slots 162 are preferably spaced 180 degrees apart, so that the discharge pipe 21 maybe positioned for either right- or left-handed discharge simply by rotating the discharge pipe 21 before attachment, without requiring changes to the other toilet components. The free end of the discharge pipe 21 is adapted for releasable connection to the sewer line 11, such as with a clam shell coupling (not shown).

In operation, when the disk apertures 86, 87 are aligned with the inlet/outlet pairs 79/81, 80/82, the discharge valve 70 not only transfers waste from the transfer pipe 44 to the sewer line 11, but also pulls additional air into the sewer line 11 through the air intake check valve 45. The additional air intake reduces noise that is normally generated during a flush.

The actuator 76 is provided for driving the valve disk 83. As best shown in FIG. 5A, the actuator 76 includes a spur gear 90 enmeshed with the gear teeth 85 formed about the periphery of the disk 83. The spur gear 90 is mounted to a rotatable shaft 92, and a drive is provided for rotating the shaft 92. The FCU 74 is operably coupled to the actuator 76 to control operation of the actuator. According to the illustrated embodiment, the disk 83 may be rotated in a single direction by ninety degree increments to open and close the discharge valve 70. Alternatively, the disk 83 may also be reciprocated back and forth across a ninety degree arc to open and close the valve 70, or the disk 83 may be controlled in other manners according to other disk designs and layouts.

Figure 6:
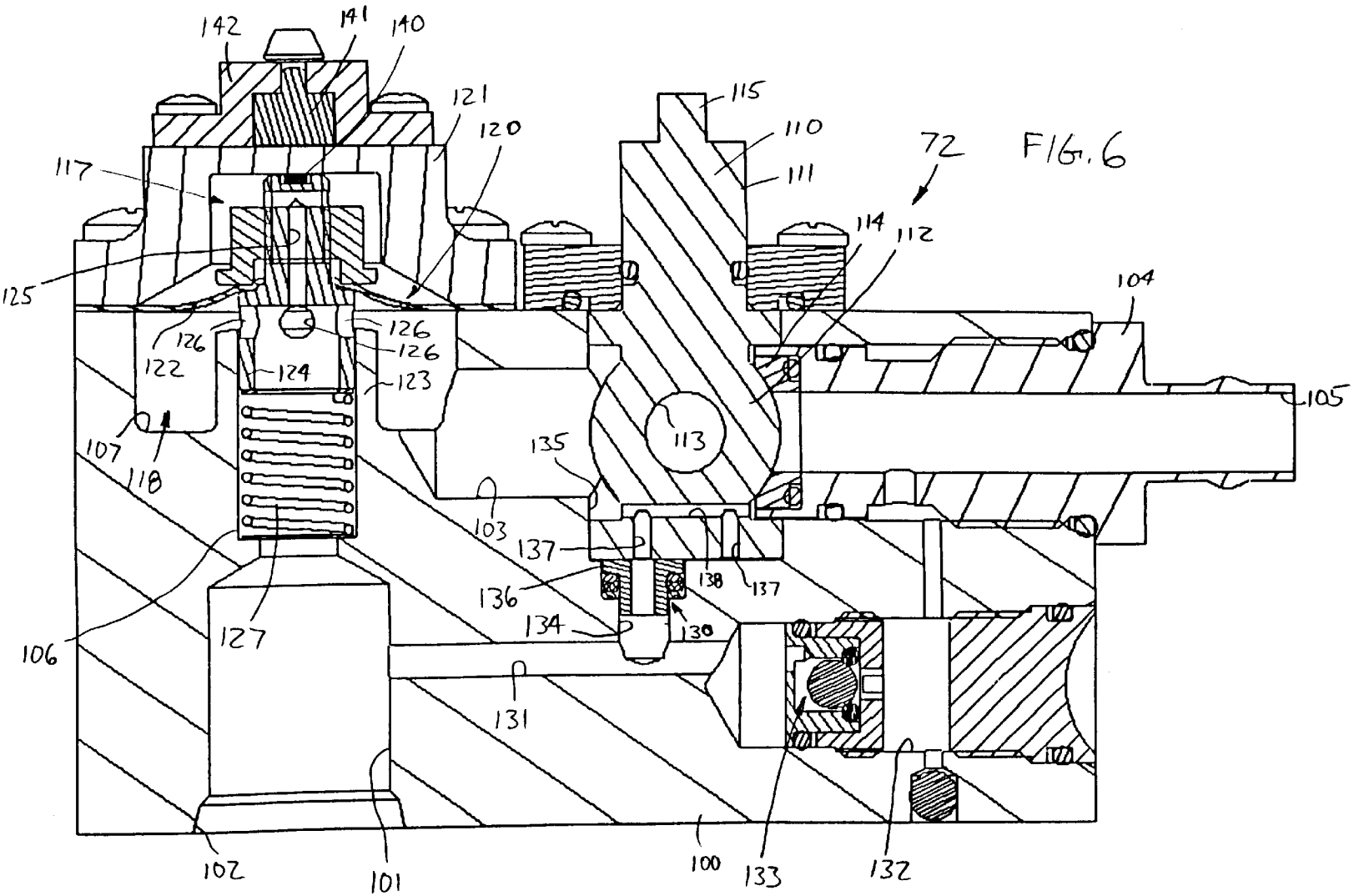
FIG. 6 is a side elevation view, in cross-section, of a rinse valve assembly incorporated into the valve set.

The rinse valve 72 is provided for controlling flow of rinse fluid to the bowl 36. As best shown in FIG. 6, the rinse valve 72 comprises a housing block 100 formed with an inlet bore 101, defining an inlet 102, and an outlet bore 103. The inlet bore 102 is adapted for connection to the rinse fluid line 19 via a quick-disconnect coupling (not shown). An insert 104 is positioned in a downstream portion of the outlet bore 103 and defines an outlet 105. The outlet end of the insert 104 is barbed to secure one end of the second rinse fluid pipe 35*b* thereto, while the opposite end of the second rinse fluid pipe 35*b* has the quick-disconnect coupling 108*b* (FIGS. 1A and 1B). A poppet valve bore 106 is also formed in the housing block 100, and fluidly communicates with the inlet bore 101. An annular recess 107 is formed in the housing block 100 concentric with the poppet valve bore 106 to establish fluid communication between the poppet valve bore 106 and the outlet bore 103.

The rinse valve 72 includes a rinse valve member, such as a ball valve 110, which is disposed in the outlet bore 103 for selectively establishing fluid communication between the outlet bore 103 and the outlet 105. The ball valve 110 includes a shaft 111 and a valve member 112 having a flow passage 113 extending therethrough. A seal 114 is provided downstream of the valve member 112 for preventing leakage between the valve member 112 and the downstream portion of the outlet bore 103. As shown in FIG. 6, the flow passage 113 is perpendicular to the outlet bore 103, thereby preventing fluid flow. The ball valve 110 is rotatable, however, to align the flow passage 113 with the outlet bore 103, thereby establishing fluid communication between the upstream portion of the outlet bore 103 and outlet 105.

In the preferred embodiment, the top of the shaft 111 is adapted to mechanically engage the axle end 84*a,* as best shown in FIG. 4, so that rotation of the disk 83 also rotates the ball valve 110. In the illustrated embodiment, the shaft 111 is formed with a key 115, while the axle end 84*a* has a slot 116 sized to receive the key 115. As a result, a separate actuator is not required to actuate the ball valve 110, thereby reducing cost and space requirements for the toilet.

The rinse valve 72 further includes a fuse valve 120 for metering rinse fluid flow through the rinse valve when the ball valve 110 is open. As used herein, the phrase "fuse valve" indicates a valve that actuates after a set value of fluid has passed therethrough. As best shown in FIG. 6, a bonnet 121 is attached to the housing block 100 to close off the poppet valve bore 106 and the recess 107. A flexible diaphragm 122 is attached between the housing block 100 and the bonnet 121 to define a pilot chamber 117 above the diaphragm 122 and a flow chamber 118 below the diaphragm 122. As illustrated at FIG. 6, the diaphragm 122 is in a closed position, in which the diaphragm 122 engages an annular intermediate wall 123 extending between the poppet valve bore 106 and recess 107, thereby closing off fluid communication between the poppet valve bore 106 and recess 107. A poppet valve 124 is disposed inside the poppet valve bore 106 and is attached to the diaphragm 122, so that the poppet valve 124 moves with the diaphragm 122. The top of the poppet valve 124 is formed with a pilot port 125, and flow ports 126 extend radially through a sidewall of the poppet valve 124. A spring 127 is disposed in the poppet valve port for biasing the diaphragm 122 away from the intermediate wall 123 toward an open position, in which fluid communication is established between the poppet valve bore 106 and the recess 107.

Figure 7A:
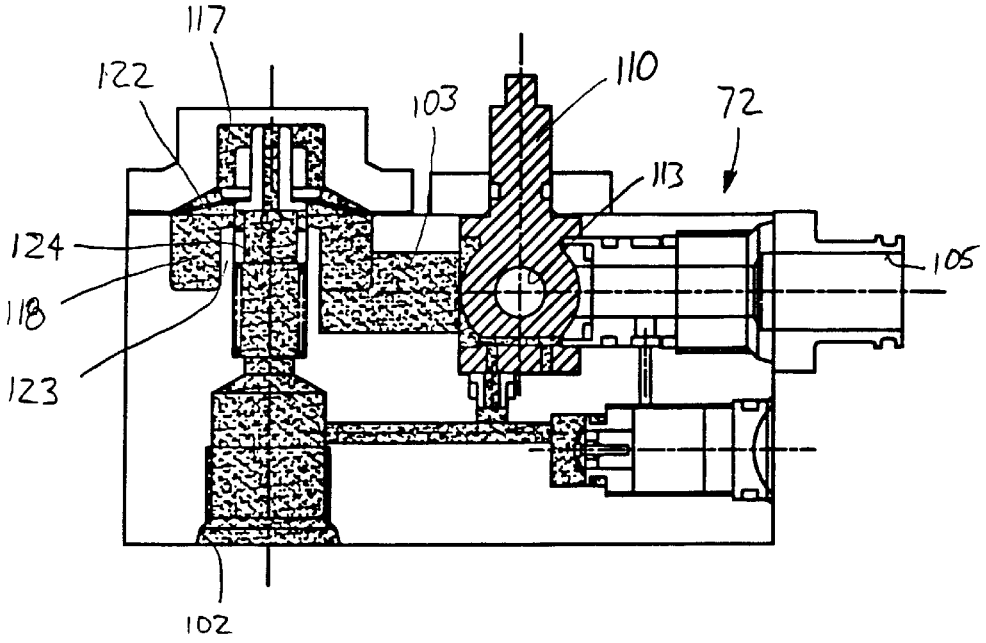
FIGS. 7A–D are side elevation views, in cross-section, of the rinse valve assembly showing the various stages of a rinse cycle.

The fuse valve 120 limits the amount of rinse fluid allowed to flow through the rinse valve 72 when the ball valve 110 is open. During operation, the ball valve 110 is normally in a closed position to prevent flow of rinse fluid through the rinse valve 72. The rinse fluid flows through both the pilot port 125 to register at the pilot chamber 117, and through the flow ports 126 to register in the flow chamber 118. Because there is no rinse fluid flow, the rinse fluid pressure is the same in both the pilot chamber 117 and the flow chamber 118, so that the spring 127 urges the diaphragm 122 and poppet valve 124 to the open position, as shown in FIG. 7A.

Figure 7C:
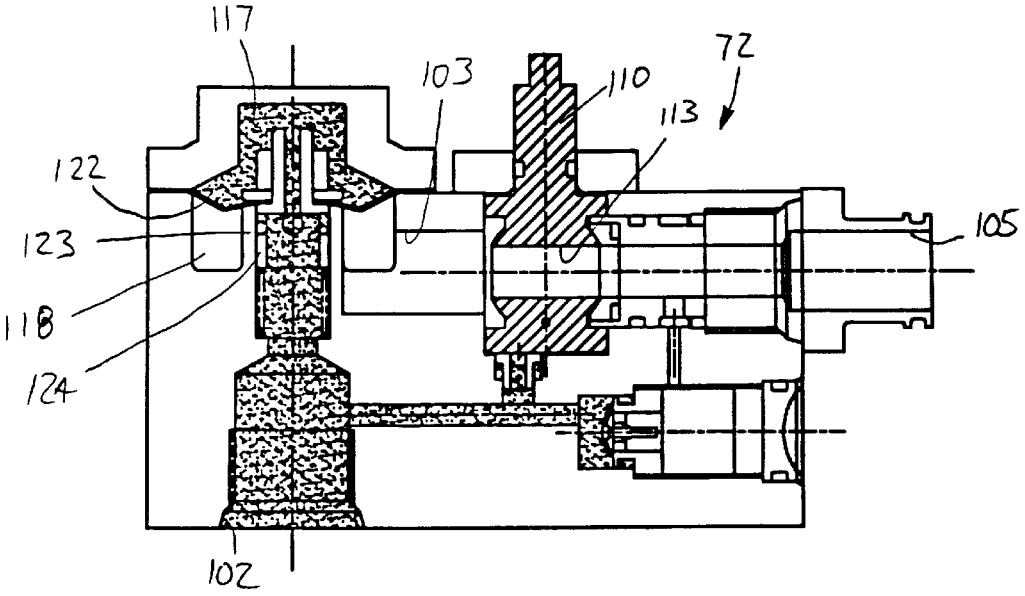
Figure 7B:
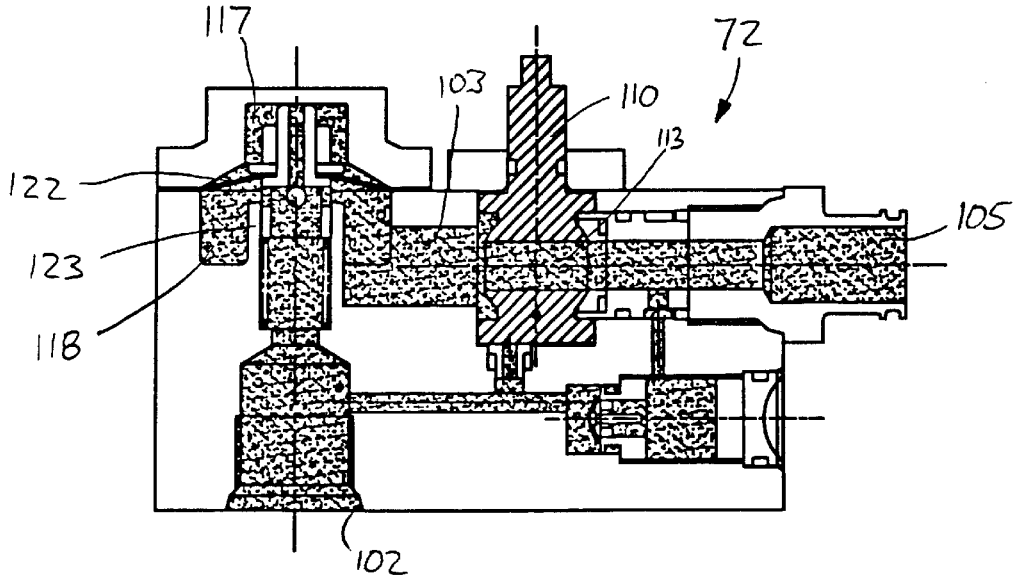

In response to a flush command, the ball valve 110 is rotated to the open position so that the ball valve flow passage 113 communicates the outlet bore 103 to the outlet 105, thereby creating fluid flow through the valve 72 (FIG. 7B). During fluid flow, the rinse fluid experiences a pressure drop as it passes through the flow ports 126, thereby reducing the fluid pressure in the flow chamber 118 while the pressure in the pilot chamber 117 stays substantially the same. The resulting pressure differential across the diaphragm 122 ultimately overcomes the force of the spring 127 so that the diaphragm 122 and poppet valve 124 move to the closed position, as shown in FIG. 7C. When the diaphragm is in the closed position, fluid flow through the rinse valve 72 is again cut off, this time by the engagement of the diaphragm 122 with the intermediate wall 123. Because of the fuse valve 120, the volume of rinse fluid passing through the open ball valve 110 is substantially constant from flush to flush, regardless of the rinse fluid pressure supplied to the rinse valve 72. It will also be appreciated that the fuse valve 120 provides a redundant shut-off, so that the ball valve 110 or the fuse valve 120 may be used to stop rinse fluid flow should the other fail.

The rinse valve 72 further includes a face valve 130 for returning the diaphragm 122 back to the open position after the ball valve 110 is subsequently closed. Referring to FIG. 6, a bypass bore 131 is formed in the housing block 100 that connects the inlet bore 101 to an auxiliary bore 132. A reset bore 134 intersects the bypass bore 131 and communicates with a ball valve bore 135 formed in the housing block 100. A reset insert 136 is inserted in the reset bore 134 and has a top surface adapted to engage a bottom of the ball valve 110. The ball valve 110 is formed with reset passages 137 extending into the ball valve 110 to a transverse passage 138 extending entirely through the ball valve 110. The reset passages 137 are located on the ball valve 110 so that they align with the reset insert 136 only when the ball valve 110 is in the closed position. The seal 114 prevents rinse fluid from leaking from the transverse passage 138 to the outlet 105. No seal is provided upstream of the ball valve 110 so that, when one of the reset passages 137 is aligned with the insert 136, fluid communication is established from the inlet bore 101, through the bypass and reset bores 131, 134 and one of the reset passages 137 to the flow chamber 118.

According to the illustrated embodiment, the rinse valve 72 also includes a drain valve 133 disposed in the auxiliary bore 132 to provide freeze protection, as is well known in the art.

Figure 7D:
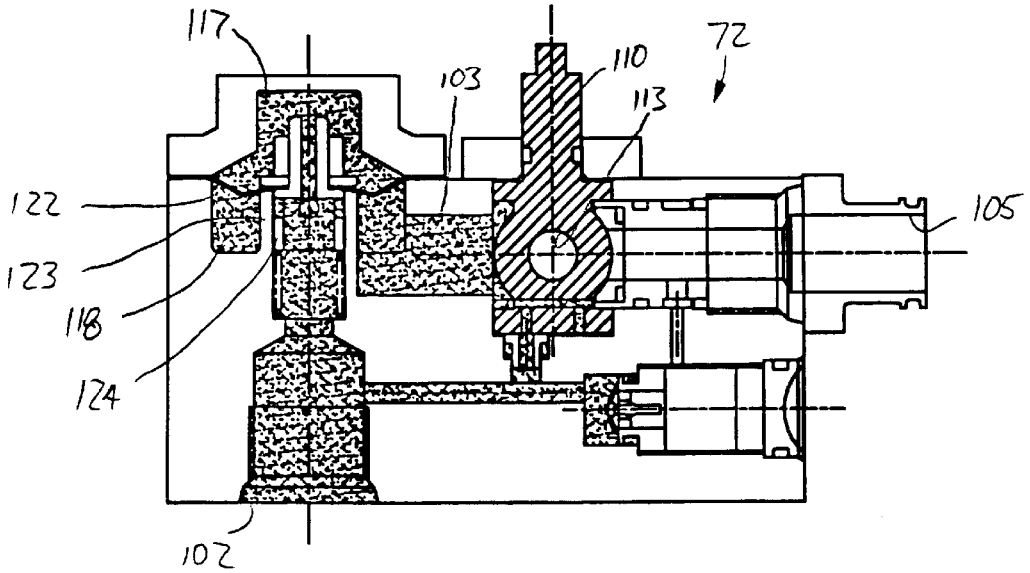

In operation, the diaphragm 122 moves to the closed position while the ball valve 110 is open, thereby stopping rinse fluid flow through the rinse valve 72 (FIG. 7C). With the ball valve 110 in the open position, neither reset passage 137 is aligned with the reset insert 136. The ball valve 110 is subsequently closed, thereby aligning one of the reset passages 137 with the insert 136 and establishing fluid communication from the inlet bore 101 to the flow chamber 118 (FIG. 7D). The incoming rinse fluid pressure registers at the flow chamber 118, so that the flow chamber reaches the same pressure as the pilot chamber 117. With the differential pressure across the diaphragm 121 removed, the spring 127 is again allowed to urge the diaphragm 121 to the open position, thereby resetting the fuse valve 120 to the position shown in FIG. 7A.

In the preferred embodiment, a position sensor is used to provide feedback regarding poppet valve position feedback. In the illustrated embodiment, a magnet 140 is attached to the poppet valve 124, and a hall effect switch 141 is located outside of the bonnet 121 in a switch enclosure 142 attached to the bonnet 121 (FIG. 6). The hall effect switch 141 provides a signal that varies according to the position of the magnet 140 to indicate the position of the poppet valve 124. The poppet valve position signal may be used for diagnostic purposes such as fault detection by comparing the position signal to the position of the disk 83 or ball valve 110.

The FCU 74 comprises a housing 150 attached to the discharge valve housing half 78*b* opposite the rinse valve 72 (FIG. 4). The housing 150 encloses one or more circuit boards (not shown) for controlling operation of the toilet 10. In addition to the typical inputs and outputs, the FCU 74 also receives feedback from the poppet valve position sensor 141.

The FCU housing 150 further houses a position sensor for determining the position of the disk 83. As best shown in FIG. 5A, magnets 152 are attached to the axle end 84*b* of the disk 83. The axle end 84*b* extends into the FCU housing 150, so that the magnets 152 are positioned proximal the control board. Hall effect switches 154 are provided directly on the circuit board for sensing the magnets 152 and thus determining the rotational position of the disk 83. In the illustrated embodiment, a pair of magnets 152 are attached to the axle end 84*b,* and a pair of hall effect switches 154 are attached to the circuit board. The switches 154 actuate between on and off positions depending on the proximity of the magnets, thereby indicating the position of the disk 83. As a result, the position of the disk 83 is directly sensed rather than inferring disk position based on actuator position. In addition, the switches 154 are located inside the FCU housing 150 and are therefore isolated from contamination due to lubrication or other material.

With the above construction, the valve set 8 is quickly and easily removed and replaced. To remove the valve set 8, the discharge pipe 21 is disconnected from the sewer line 11, the rinse valve inlet 102 is disconnected from the rinse supply line 19, and the quick-disconnect coupling 108*b* of the second rinse fluid pipe 35*b* is disconnected from the vacuum breaker 33. The knurled screws 37 are then removed from the bracket 27 and the valve set 8 with attached transfer pipe 44 is lowered so that the transfer pipe disengages the bowl outlet 42. Thus the valve set 8 is removed with the transfer pipe 44, outlet pipe 12, discharge pipe 21, and second rinse pipe 35*b*. A new valve set 8, also having a new transfer pipe 44, outlet pipe 12, discharge pipe 21, and second rinse pipe 35*b* may then be attached to the bracket 27 and reconnected.

From the foregoing, it will be appreciated that the valve set 8 of the present invention incorporates all of the valve and control apparatus. The rinse valve 72, FCU 74, and actuator 76 are all mounted to the discharge valve 70 to create an LRU, wherein a single module may be targeted for maintenance in the event of a valve or control failure. The wiring between the components may remain in place so that, in the event of a valve or control failure, only the piping connections between the valve set 8 and the drain, sewer, and rinse water piping need be undone to remove the valve set 8.

Maintenance of the modular vacuum toilet 10 is entirely different from that of conventional vacuum toilets. Instead of defining the entire toilet as an LRU, the toilet 10 defines individual components or groups of components as LRUs. The bowl 36 may be independently removed from the toilet 10 and replaced. Similarly, the valve set 8 may be separately removed from the toilet 10. Furthermore, the individual components may be quickly removed with the use of few or no tools.

The branch 17 and discharge pipe 21 of the valve set 8 are adapted to provide both right- and left-handed discharge configurations without additional modifications to the other toilet components, thereby further reducing the number of parts needed in stock.

The foregoing detailed description has been given for clearness of understanding only, and no unnecessary limitations should be understood therefrom, as modifications would be obvious to those skilled in the art.

What is claimed is:

1. A modular vacuum toilet for use in a vacuum toilet system having a sewer line placeable under partial vacuum pressure and a source of rinse fluid, the modular vacuum toilet comprising:

a support structure;

a removable bowl supported by the support structure, the bowl defining an outlet and having a rinse fluid dispenser associated therewith, the bowl defining a first line replaceable unit;

a valve set module defining a second line replaceable unit, the valve set module including:

a discharge valve having an inlet in fluid communication with the bowl outlet, an outlet in fluid communication with the sewer line, and a movable discharge valve member disposed between the discharge valve inlet and outlet;

a rinse fluid valve having an inlet in fluid communication with the source of rinse fluid, an outlet in fluid communication with the rinse fluid dispenser, and a movable rinse fluid valve member disposed between the rinse fluid valve inlet and outlet; and a flush control unit having a circuit board operably connected to the discharge valve and rinse fluid valve for controlling actuation of the discharge valve member and rinse fluid valve member;

wherein the first line replaceable unit is independently replaceable from the toilet and the second line replaceable unit; and wherein the second line replaceable unit is independently replaceable from the toilet and the first line replaceable unit.

2. The modular vacuum toilet of claim 1, in which the support structure comprises a frame.

3. The modular vacuum toilet of claim 2, in which the frame defines an opening, and in which the bowl includes a sidewall sized for insertion into the opening.

4. The modular vacuum toilet of claim 1, in which the support structure includes slots, and in which the bowl includes tabs adapted to lockingly engage the slots, thereby to secure the bowl in place.

5. The modular vacuum toilet of claim 4, in which the tabs are manually releasable to disengage from the slots.

6. The modular vacuum toilet of claim 1, in which a rinse fluid pipe communicates between the rinse fluid valve outlet and the rinse fluid dispenser, wherein the rinse fluid pipe is releasably attached to the rinse fluid valve outlet with a coupling.

7. The modular vacuum toilet of claim 6, in which the coupling is manually releasable.

8. The modular vacuum toilet of claim 1, in which a transfer pipe has a first end connected to the discharge valve inlet, and a second end adapted to releasably engage the bowl outlet.

9. The modular vacuum toilet of claim 8, in which the second end of the transfer pipe includes a collar sized to releasably engage and seal with the bowl outlet.

10. The modular vacuum toilet of claim 1, in which a rinse fluid line communicates between the rinse fluid valve inlet and the source of rinse fluid, wherein the rinse fluid valve inlet is releasably connected to the rinse fluid line with a coupling.

11. The modular vacuum toilet of claim 10, in which the coupling is manually releasable.

12. The modular vacuum toilet of claim 1, in which a discharge pipe communicates between the discharge valve outlet and the sewer line, wherein the discharge pipe is adapted for releasable connection to the sewer line.

13. The modular vacuum toilet of claim 1, in which the support structure includes a bracket, and in which fasteners are provided for releasably securing the valve set module to the bracket.

14. The modular vacuum toilet of claim 13, in which the fasteners comprise knurled screws.

15. A method of servicing a modular vacuum toilet in which the toilet has a first line replaceable unit including a waste receptacle for receiving waste and being supported by a support structure, the waste receptacle defining an outlet and having a rinse fluid dispenser associated therewith; the toilet further including a discharge valve having an inlet in fluid communication with the receptacle outlet, an outlet in fluid communication with a sewer line placeable under partial vacuum pressure, and a moveable discharge valve member disposed between the discharge valve inlet and the discharge valve outlet; a rinse fluid valve having an inlet in fluid communication with a source of rinse fluid, an outlet in fluid communication with the rinse fluid dispenser, and a moveable rinse fluid valve member disposed between the rinse fluid valve inlet and the rinse fluid valve outlet; and a flush control unit adapted to control actuation of the discharge valve member and rinse fluid valve member; in which at least two of the discharge valve, rinse fluid valve, and flush control unit are provided as a valve set forming a second line replaceable unit, the method comprising:

replacing the first line replaceable unit with a new first line replaceable unit independently of the toilet and the second line replaceable unit or the second line replaceable unit with a new second line replaceable unit independently of the toilet and the first line replaceable unit.

16. The method of claim 15, in which the vacuum toilet comprises a stationary support structure, and in which the waste receptacle is adapted to releasably engage the support structure.

17. The method of claim 16, in which the support structure includes slots, and in which the waste receptacle includes tabs adapted to lockingly engage the slots, thereby to secure the waste receptacle in place.

18. The method of claim 17, in which the tabs are manually releasable to disengage from the slots.

19. The method of claim 15, in which the discharge valve, rinse fluid valve, and flush control unit are integrally provided in a valve set, and in which the valve set forms the second line replaceable unit.

20. The method of claim 15, in which a rinse fluid pipe communicates between the rinse fluid valve outlet and the rinse fluid dispenser, wherein the rinse fluid pipe is releasably attached to the rinse fluid dispenser with a coupling.

21. The method of claim 20, in which the coupling is manually releasable.

22. The method of claim 15, in which a transfer pipe has a first end connected to the discharge valve inlet, and a second end adapted to releasably engage the waste receptacle outlet.

23. The method of claim 22, in which the second end of the transfer pipe includes a collar sized to releasably engage and seal with the waste receptacle outlet.

24. The method of claim 15, in which a rinse fluid line communicates between the rinse fluid valve inlet and the source of rinse fluid, wherein the rinse fluid valve inlet is releasably connected to the rinse fluid line with a coupling.

25. The method of claim 24, in which the coupling is manually releasable.

26. The method of claim 15, in which a discharge pipe communicates between the discharge valve outlet and the sewer line, wherein the discharge pipe is adapted for releasable connection to the sewer line.

27. The method of claim 15, in which the vacuum toilet includes a support structure having a bracket, and in which fasteners are provided for releasably securing the valve set to the bracket.

28. The method of claim 27, in which the fasteners comprise knurled screws.

* * * * *